US009555300B2

(12) United States Patent
Abbott et al.

(10) Patent No.: US 9,555,300 B2
(45) **Date of Patent: *Jan. 31, 2017**

(54) PUTTER FACE INSERT

(71) Applicant: CALLAWAY GOLF COMPANY, Carlsbad, CA (US)

(72) Inventors: Craig E. Abbott, Vista, CA (US); Alan Hocknell, Encinitas, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/006,364

(22) Filed: Jan. 26, 2016

(65) Prior Publication Data

US 2016/0158611 A1 Jun. 9, 2016

Related U.S. Application Data

(63) Continuation of application No. 14/538,165, filed on Nov. 11, 2014, now Pat. No. 9,265,996, which is a (Continued)

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/04* (2013.01); *A63B 53/047* (2013.01); *A63B 53/0466* (2013.01); *A63B 53/0475* (2013.01); *A63B 2053/042* (2013.01); *A63B 2053/0408* (2013.01); *A63B 2053/0416* (2013.01); *A63B 2053/0425* (2013.01); *A63B 2053/0429* (2013.01); (Continued)

(58) Field of Classification Search
CPC ... A63B 53/0487; A63B 53/007; A63B 53/04; A63B 2053/042; A63B 2053/0416; A63B 2053/0425; A63B 2053/0429
USPC 273/342, 343, 345, 340, 350, 329; 473/342, 343, 345, 340, 350, 329
See application file for complete search history.

(56) References Cited

U.S. PATENT DOCUMENTS 1,968,092 A * 7/1934 Oldham ..... A63B 53/04 473/342
6,699,140 B1 * 3/2004 Sun ..... A63B 53/0487 473/252

(Continued)

*Primary Examiner* — Benjamin Layno
(74) *Attorney, Agent, or Firm* — Rebecca Hanovice; Michael Catania; Sonia Lari

(57) ABSTRACT

A face insert comprising a planar member composed of a rigid material such as plastic or metal and a polymeric backing is disclosed herein. The planar member, which makes contact with a golf ball during use, includes a plurality of geometrically-shaped holes, each of which comprises a perimeter edge that has a variable radius to further optimize performance of the face insert. In some embodiments, one or more of the holes extends completely through the planar member, i.e. is a through-hole, and the polymeric backing includes at least one protrusion with an angled upper surface that is sized to extend into a through-hole and further improve performance of the face insert. The face insert described herein can be used with any type of golf club head, including putters, woods, irons, and hybrids, and the holes may take any shape, including oval, hexagonal, and chevron.

19 Claims, 5 Drawing Sheets

Related U.S. Application Data continuation-in-part of application No. 14/205,991, filed on Mar. 12, 2014, now Pat. No. 8,915,798, which is a continuation of application No. 13/797,666, filed on Mar. 12, 2013, now Pat. No. 8,696,492, which is a continuation-in-part of application No. 13/445,757, filed on Apr. 12, 2012, now Pat. No. 8,684,860, which is a continuation-in-part of application No. 29/414,722, filed on Mar. 2, 2012, now Pat. No. Des. 672,418.

(60) Provisional application No. 61/609,737, filed on Mar. 12, 2012.

(52) U.S. Cl.
CPC ..... *A63B 2053/0445* (2013.01); *A63B 2053/0458* (2013.01); *A63B 2209/00* (2013.01); *A63B 2209/10* (2013.01)

(56) References Cited

U.S. PATENT DOCUMENTS

| | | | | |
|---|---|---|---|---|
| 9,265,996 | B1 * | 2/2016 | Abbott | A63B 53/0466 |
| 2004/0009829 | A1 * | 1/2004 | Kapilow | A63B 53/04 473/342 |
| 2005/0020378 | A1 * | 1/2005 | Krumme | A63B 53/04 473/332 |

* cited by examiner

PUTTER FACE INSERT

CROSS REFERENCES TO RELATED APPLICATIONS

The present application is a continuation of U.S. patent application Ser. No. 14/538,165, filed on Nov. 11, 2014, and issued as a U.S. Pat. No. 9,265,996 on Feb. 23, 2016, which is a continuation-in-part of U.S. patent application Ser. No. 14/205,991, filed on Mar. 12, 2014, and issued as U.S. Pat. No. 8,915,798 on Dec. 23, 2014, which is a continuation of U.S. patent application Ser. No. 13/797,666, filed on Mar. 12, 2013, and issued as U.S. Pat. No. 8,696,492 on Apr. 15, 2014, which is a continuation-in-part of U.S. patent application Ser. No. 13/445,757, filed on Apr. 12, 2012, which issued as U.S. Pat. No. 8,684,860 on Apr. 1, 2014, which is a continuation-in-part of and claims priority to U.S. Design patent application No. 29/414,722, filed on Mar. 2, 2012, which issued as U.S. Design Pat. No. D672,418 on Dec. 11, 2012, and also claims priority to U.S. Provisional Patent Application No. 61/609,737, filed on Mar. 12, 2012, the disclosure of each of which is hereby incorporated by reference in its entirety herein.

STATEMENT REGARDING FEDERALLY SPONSORED

RESEARCH OR DEVELOPMENT

Not Applicable

BACKGROUND OF THE INVENTION

Field of the Invention

The present invention relates to a golf club face insert. More specifically, the present invention relates to a face insert for putter-type golf club heads having improved feel and performance qualities.

Description of the Related Art

The prior art discloses many different types of golf club heads, especially putter-type golf club heads. Although these inventions have disclosed various types of face inserts for said putter-type golf club heads, the prior art has not provided an optimized face insert that provides improved feedback and feel during putting combined with improved performance.

BRIEF SUMMARY OF THE INVENTION

The present invention provides a novel face insert that optimizes golf club performance, and particularly improves putter control over a golf ball interacting with the face. For example, one aspect of the present invention is a golf club face insert comprising a planar member comprising a front surface, a back surface, a first upper edge, a first lower edge, and a plurality of oval-shaped holes, wherein at least one of the plurality of oval-shaped holes has a perimeter edge comprising a second upper edge disposed closer to the first upper edge and a second lower edge disposed closer to the first lower edge, wherein the perimeter edge is disposed proximate the front surface of the sheet, and wherein the radius of the perimeter edge varies around the at least one oval-shaped hole. In some embodiments, the second lower edge may have a smaller radius than the second upper edge. In further embodiments, the second lower edge may have a radius of up to 0.005 inch, and the second upper edge may have a radius of 0.010 inch to 0.040 inch.

In some embodiments, each of the plurality of oval-shaped holes may have a perimeter edge with a variable radius. In other embodiments, at least one of the plurality of oval-shaped holes may have a width of 0.150 inch to 0.200 inch and a height of 0.020 to 0.060 inch. In still other embodiments, the planar member may be composed of a rigid material, and may have a thickness of no less than 0.005 inch and no more than 0.100 inch. In yet another embodiment, at least one of the plurality of oval-shaped holes may be a through-hole that extends completely through the planar member. In a further embodiment, the golf club face insert may comprise a backing, which may include at least one protrusion that extends into the through-hole. The protrusion may have an angled upper surface with a slope of 5° to 20°, and the angled upper surface may comprise an uppermost edge located proximate the second lower edge and a lowermost edge located proximate the second upper edge. In a further embodiment, the protrusion may comprise a protrusion edge having a constant radius that is equivalent to the radius of the second lower edge. In some embodiments, the planar member may be composed of a metal material, while in other embodiments the planar member may be composed of a polymeric material.

Another aspect of the present invention is a golf club head comprising a body comprising a top surface, a bottom surface, a heel side, a toe side, and a face recess, and a face insert comprising a planar member and a backing, wherein the planar member comprises a front surface, a first upper edge, a first lower edge, and plurality of oval-shaped holes extending into the front surface, wherein each of the plurality of oval-shaped holes has a width of 0.150 inch to 0.200 inch and a height of 0.020 to 0.060 inch, wherein each of the plurality of oval-shaped holes has a perimeter edge comprising a second upper edge disposed closer to the first upper edge and a second lower edge disposed closer to the first lower edge, wherein each perimeter edge is disposed proximate the front surface of the planar member, wherein each perimeter edge has a variable radius, wherein the second lower edge has a radius that is less than a radius than that of the second upper edge, wherein the face insert is sized to fit within the face recess, and wherein the face insert is secured within the face recess with an adhesive material.

In some embodiments, the golf club head may be selected from the group consisting of a fairway head, driver head, hybrid head, iron head, and putter head. In other embodiments, at least one of the plurality of oval-shaped holes may be a through-hole that extends completely through the planar member. In a further embodiment, the backing may comprise at least one protrusion that extends into the through-hole. The protrusion may comprise an angled upper surface with a slope of 5° to 20°, and may also include a protrusion edge having a constant radius, which may be equivalent to the radius of the second lower edge.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to an improved face insert for use in golf club heads, particularly putters, though it may be used in connection with wood-type golf club heads like fairways, drivers, and hybrids, as well as with iron-type golf club heads.

Figure 1:
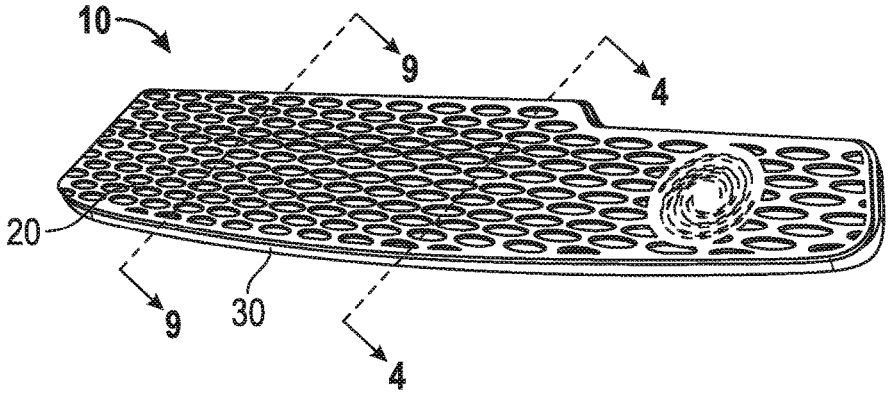
FIG. 1 is a front perspective view of a first embodiment of the present invention.
Figure 4:
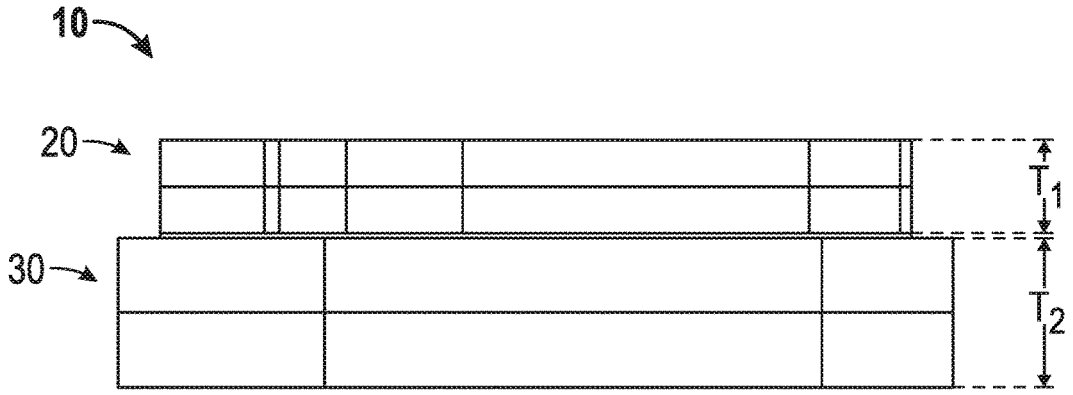
FIG. 4 is a cross-sectional of the embodiment shown in FIG. 1 along lines 4-4.

In a first embodiment, shown in FIGS. 1 and 4, the face insert 10 comprises a metal striking sheet 20 or planar member, which is preferably composed of 6061 aluminum, and a polymeric backing 30, which is preferably composed of a urethane having a hardness of Shore 40D to 60D. The metal sheet 20, which is designed to make contact with and grip a golf ball, includes a textured surface 22 composed of a plurality of oval-shaped holes 24 that are stamped into the metal sheet 20, the edges of which are then machined to achieve sharpness. The holes 24 in this embodiment do not extend through the entire thickness $T_1$ of the metal sheet 20, but in an alternative embodiment, disclosed herein, they may do so. In alternative embodiments of the present invention, the striking sheet 20 may be made of any metal material that has similar properties to 6061 aluminum, or out of titanium, stainless steel, or a hard plastic, and the holes 24 may be machined into the sheet 20 instead of stamped. In these alternative embodiments, the holes 24 may have one or more different, geometric shapes.

Figure 2A:
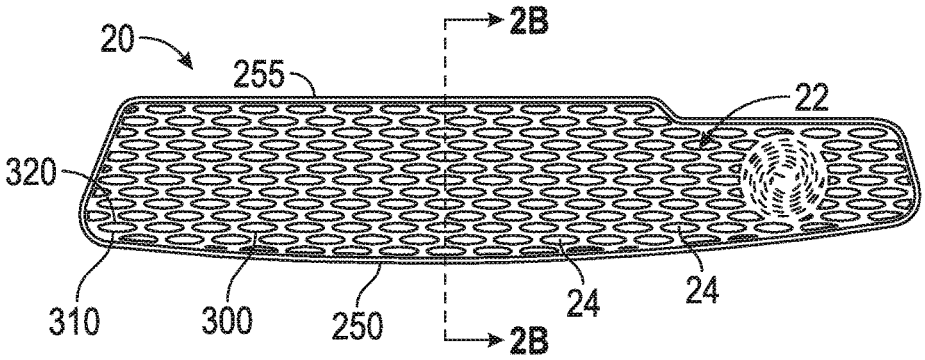
FIG. 2A is a front plan view of part of the embodiment shown in FIG. 1.
Figure 2B:
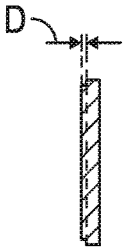
FIG. 2B is a cross-sectional view of the embodiment shown in FIG. 2A along lines 2B-2B.
Figure 2C:
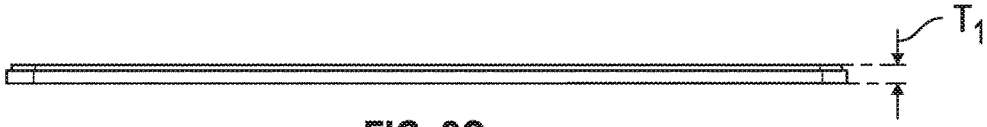
FIG. 2C is a bottom plan view of the embodiment shown in FIG. 2A.
Figure 3:
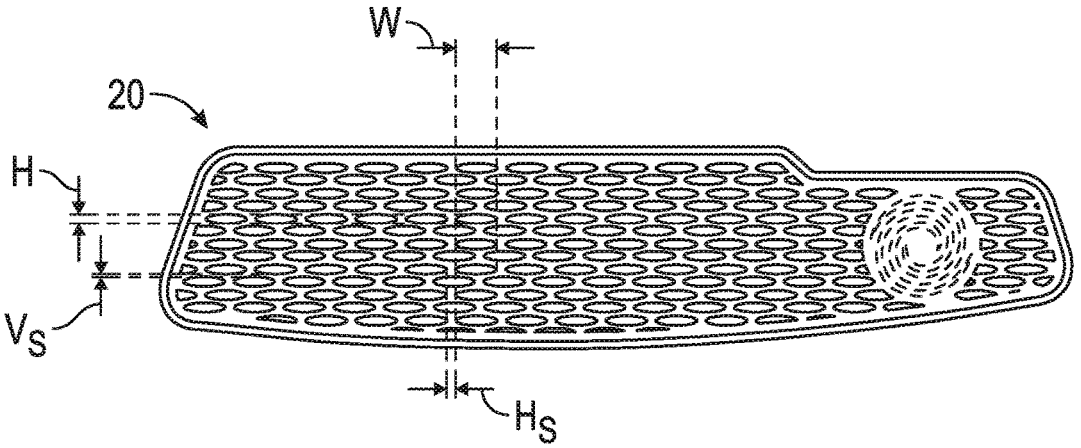
FIG. 3 is another front plan view of the part of the embodiment shown in FIG. 2A.

The specific dimensions of the metal sheet 20, including the holes 24, allow the face insert 10 to grip the surface of a golf ball. As shown in FIGS. 2B-3, in this embodiment, the metal sheet 20 has a thickness $T_1$ of 0.050 inch to 0.100 inch, more preferably 0.075 inch, while the holes 24 have a depth D of 0.005 inch to 0.015 inch, more preferably 0.012 inch, a height H of 0.020 to 0.060 inch, more preferably 0.040 inch, and width W of 0.150 inch to 0.200 inch, more preferably 0.180 inch. To maximize the gripping effect, the holes 24 have vertical spacing Vs from each other of 0.005 to 0.011 inch, more preferably 0.009 inch, and horizontal spacing Hs of 0.01 to 0.03 inch, more preferably 0.026 inch.

While the metal sheet 20 makes contact with and grips the golf ball, the backing 30 absorbs the force of contact with a golf ball, allowing for the ball to make longer contact with the metal sheet 20 portion of the face insert 10 and providing desired performance characteristics. To maximize the absorption of the force of impact with a golf ball, the backing 30 preferably has a thickness $T_2$ of 0.100 to 0.150 inch, and more preferably a thickness of approximately 0.120 inch. Though the backing 30 preferably is composed of a urethane material having a hardness of Shore 60D, in alternative embodiments the backing may be composed of non-metal materials having similar performance characteristics. In some embodiments, the backing 30 may be composed of materials having a hardness of Shore 40D-55D, which yield slower ball speed.

Figure 5:
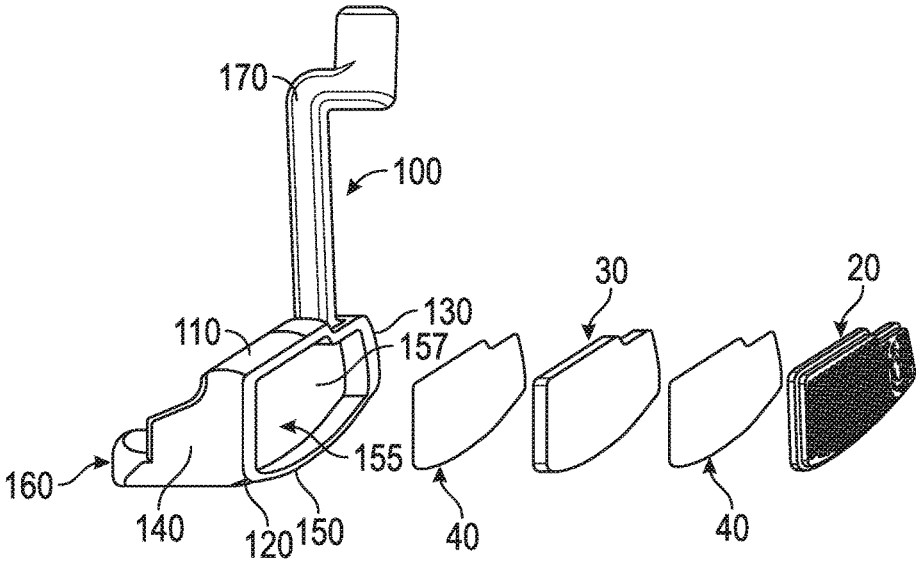
FIG. 5 is an exploded perspective view of the embodiment shown in FIG. 1 in combination with an exemplary golf club head.

FIG. 5 shows an exemplary putter head 100 into which the face insert 10 of the present invention can be inserted. The putter head 100 includes a top surface, a bottom surface 120, a heel side 130, a toe side 140, a face portion 150 including a recess 155, a rear portion 160, and a hosel 170. The metal sheet 20 is bonded to the backing 30 with an adhesive 40 that is evenly applied over a back surface of the metal sheet 20, and then the backing 30 is bonded to a bottom surface 157 of the recess 155 with an adhesive 40.

The particular dimensions and materials disclosed herein with respect to the first embodiment of the present invention provide a golf club containing this face insert 10 with more control over the golf ball's spin than prior art clubs. Testing was performed using the putter head 100 shown in FIG. 5 and two commercially available putter products. A golfer hit five putts with each putter and the results of these hits were measured and analyzed. As shown in Table 1 below, though Commercial Product 1 produced more top spin, it also launched the ball at an undesirably high angle, which caused the ball to bounce. While Commercial Product 2 launched the golf ball at a lower angle than Commercial Product 1, it created an undesirably low spin rate. The putter head of the present invention produced more top spin that Commercial Product 2 and a launched the golf ball at a much lower angle than both Commercial Products, causing less bounce than both of these clubs and a more constant deceleration of the golf ball during its skid phase. This, in turn, produced a smoother and more consistent roll in both appearance and distance control.

TABLE 1

| Golf Club | Ball Speed | Launch Angle | Spin Rate |
|---|---|---|---|
| First embodiment | 5.62 mph | 2.34° | 48.73 rpm |
| Commercial Product 1 | 5.47 mph | 4.20° | 86.76 rpm |
| Commercial Product 2 | 5.85 mph | 3.16° | 33.83 rpm |

Figure 6:
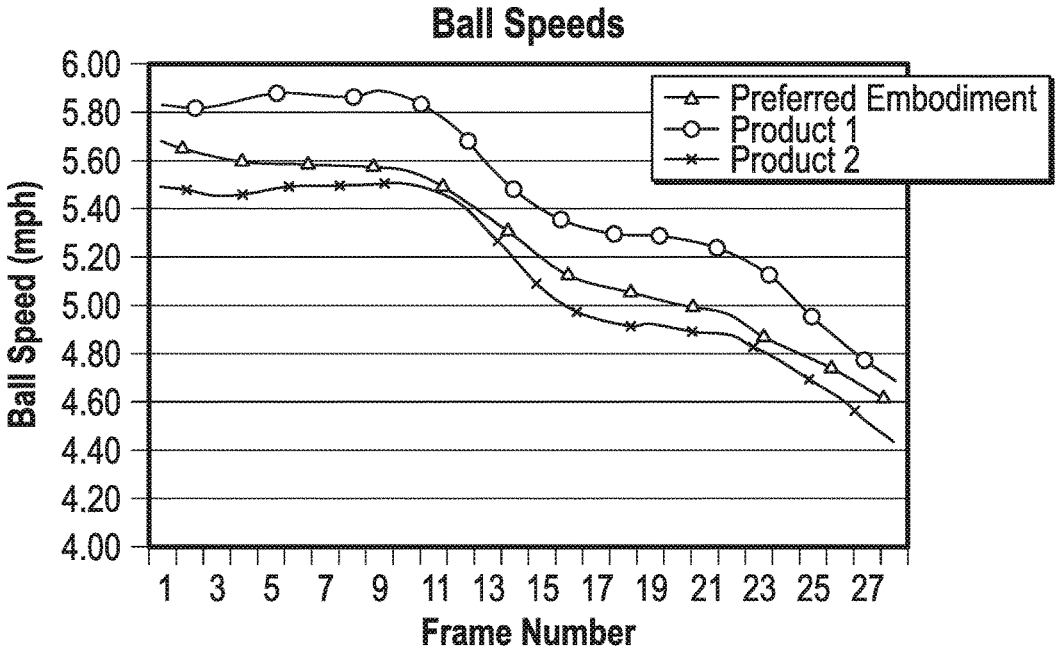
FIG. 6 is a graph comparing ball speeds imparted by the embodiment shown in FIG. 5 with ball speeds imparted by other commercial putters.

The deceleration of golf balls hit by each golf club in Table 1 was also analyzed, as shown in FIG. 6. The speed deceleration of a golf ball struck by the putter head 100 shown in FIG. 5 was more constant, and resulted in a flatter line in the plotted graph of FIG. 6 than the other two putters. This due to the combination of a lower launch angle with the right amount of top spin, which minimized bouncing and produced more consistent deceleration and thus a smoother, more consistent roll.

In another test, the spin of golf balls hit at different head speeds, which are representative of different putting distances, was measured using a putter including a face having the above-described embodiment of the present invention and a putter having a smooth face. Launch angles were also measured for each club and each head speed. As shown in Table 2, the embodiment of the invention causes golf balls to launch at lower angles and with more top spin than the traditional, smooth-faced putter, thus providing a golfer with more control over the ball.

TABLE 2

| Golf Club Face | Measurement | 4.5 mph (3.5 foot putt) | 6 mph (8 foot putt) | 7.5 mph (20 foot putt) |
|---|---|---|---|---|
| Smooth | Spin (rpm) | 8.76 | 0.27 | −7.12 |
| | Launch (deg) | 3.27 | 3.19 | 2.91 |
| | Ball Speed (mph) | 4.48 | 5.589 | 7.78 |
| First Embodiment | Spin (rpm) | 16.52 | 10.00 | 11.08 |
| | Launch (deg) | 3.26 | 2.74 | 2.26 |
| | Ball Speed (mph) | 4.39 | 5.83 | 7.64 |

Figure 7:
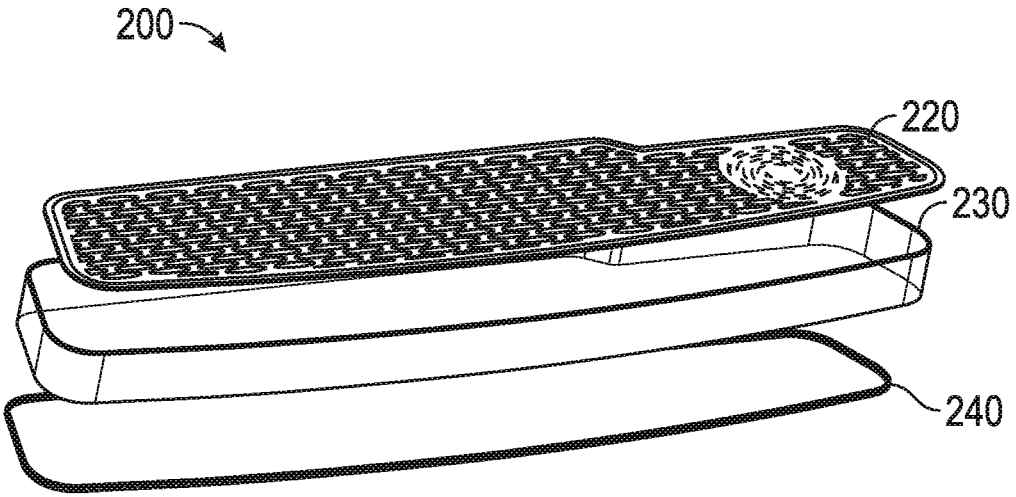
FIG. 7 is an exploded, perspective view of a second embodiment of the present invention.
Figure 8:
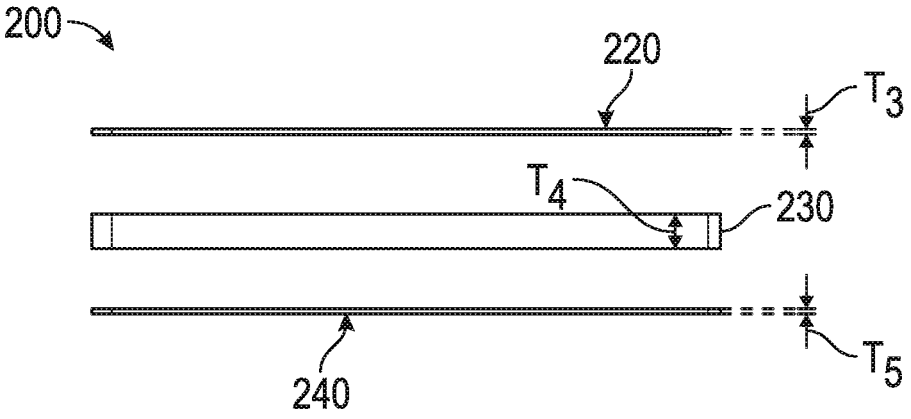
FIG. 8 is a side, plan view of the embodiment shown in FIG. 7.

A preferred embodiment of the present invention is shown in FIGS. 7-8. In this embodiment, a striking sheet 220 or planar member with a thickness $T_3$ of 0.005 to 0.020 inch, and more preferably 0.007 to 0.016, inch is permanently affixed to a urethane backing 230 with a thickness $T_4$ of approximately 0.200±0.050 inch using adhesive, preferably 3M 7533 adhesive that is applied to one or both of the striking sheet 220 and urethane backing 230 via silk screening. The striking sheet 220 includes the textured surface 22 pattern disclosed herein, with oval-shaped holes 24 having the dimensions and spacing disclosed herein. In this preferred embodiment, however, the oval-shaped holes 24 extend completely through the thickness $T_3$ of the striking sheet 220, giving the striking sheet 220 a mesh-like structure. Another adhesive layer 240 with a thickness $T_5$ of approximately 0.015±0.010 inch is then affixed to the back of the urethane backing 230, and the resulting face insert 200 is inserted into a recess in a golf club head 100 as shown in FIG. 5. This embodiment is preferred because it combines the feel of a urethane face with the improved gripping technology of a striking sheet 220 with an improved, textured surface 22, the benefits of which are demonstrated in Tables 1 and 2 and FIG. 6 herein.

Figure 9:
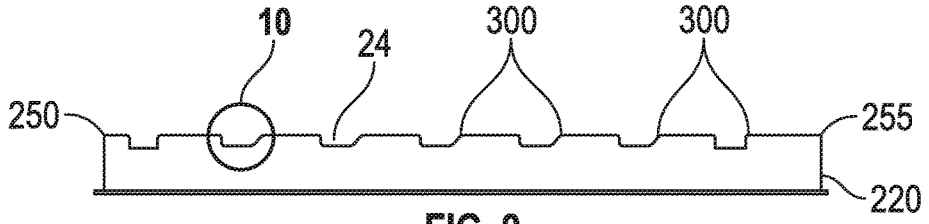
FIG. 9 is a cross-sectional view of the striking sheet shown in FIG. 1 along lines 9-9.
Figure 10:
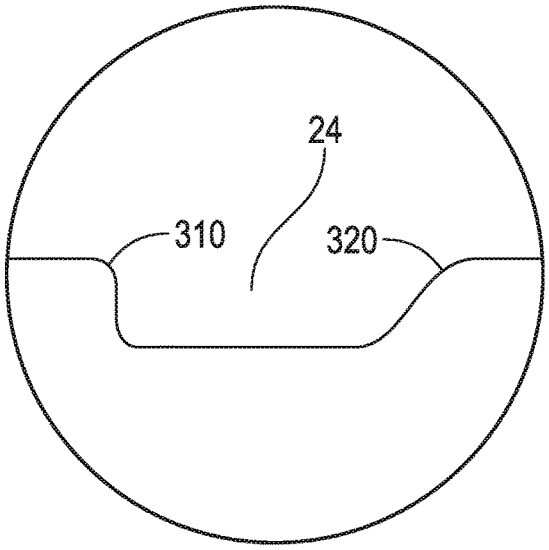
FIG. 10 is a magnified view of the circled portion of the striking sheet shown in FIG. 9.

In each of the embodiments disclosed herein, the edges of the oval-shaped holes 24 preferably are shaped to improve performance of the face insert 10, 200. In particular, as shown in FIGS. 2A and 9-10, each oval-shaped hole 24 preferably comprises a perimeter edge 300 with a radius that varies or transitions around the oval-shaped hole 24, such that the lower edges 310 of each oval-shaped hole 24 are sharp, e.g., have small radii ranging from 0.00 inch to 0.005 inch, whereas the upper edges 320 of each oval-shaped hole 24 are gently curved and have larger radii ranging from 0.010 inch to 0.040 inch. The lower edges 310 are so defined because they are closer to a lower edge 250 of the striking sheet 220 when a golf club head including the face insert 10, 200 is at address, while the upper edges 320 are closer to an upper edge 255 of the striking sheet 220 when a golf club head including the face insert 10, 200 is at address.

The smaller radii on the lower edges 310 serve to control a golf ball that connects with the face insert 10, 200 on an upswing, producing desirable forward spin. In contrast, the larger radii on the upper edges 320 interact less aggressively with a golf ball 10, 200 connecting with the face insert 10, 200 on a downswing, such that the upper edge 320 doesn't catch the ball and make it skip. While beneficial when used in connection with the oval-shaped holes 24 described herein, the variable radius perimeter edge 300 can also be used in connection with holes having other shapes, including but not limited to circular, rectangular, chevron-shaped, and hexagonal, to better control golf ball performance off of the face insert 10, 200.

Figure 11:
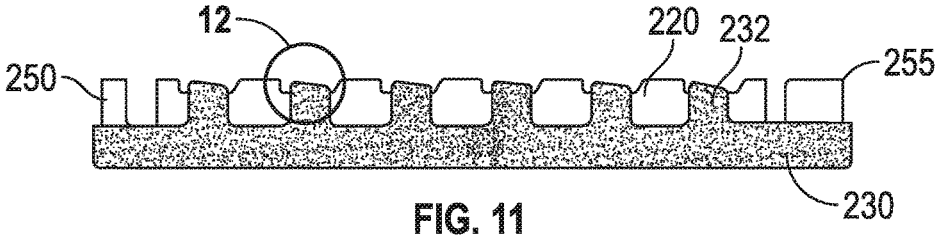
FIG. 11 is a cross sectional view of a third embodiment of the present invention.
Figure 12:
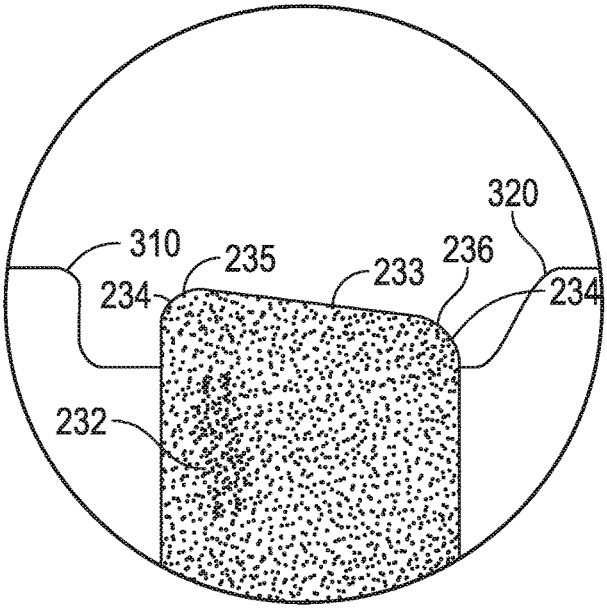
FIG. 12 is a magnified view of the circled portion of the present invention shown in FIG. 11.

In an alternative embodiment of the preferred invention, shown in FIGS. 11-12, the backing 230 comprises a plurality of protrusions 232 extending upwards and into the oval shaped holes 24 of the striking sheet 220. Each protrusion 232 preferably has an angled upper surface 233 with a slope ranging from 5 to 20°, and more preferably 10°, with the slope extending downwards from a first location 235 on the protrusion 232 closest to the lower edge 310 to a second location 236 on the protrusion 232 closest to the upper edge 320 of whichever oval-shaped hole the subject protrusion 232 extends into. The radius of the edge 234 of the protrusion 232 preferably is constant, and may range from 0.00 inch to 0.040 inch, but preferably is the same as the radius of the lower edge 310 of whichever oval-shaped hole 24 the subject protrusion 232 extends into, and more preferably is no more than about 0.005 inch. The protrusions 232 may have any geometric cross-sectional shape, including but not limited to oval, cylindrical, square, diamond, chevron-shaped, and hexagonal.

In the preferred embodiment, the striking sheet 220 is composed of a metal material, which may be aluminum, steel, titanium, nickel titanium, or another lightweight, high strength material, and more preferably is composed of aluminum. In alternative embodiments, however, the striking sheet 220 may be composed of a high strength, non-metal material, such as plastic or composite. Similarly, in the preferred embodiment, the urethane backing 230 is composed of a urethane having a hardness of Shore 42D, but in other embodiments the hardness of the urethane backing 230 may range from 40D to 60D, including hardnesses of Shore 50D-55D.

In yet another embodiment, the oval patterns described herein are formed within a solid metal face of a putter using any means known to a person skilled in the art, including, but not limited to, chemical etching, electroforming, machining, and stamping. These methods may also be used to form the textured surface of any of the embodiments disclosed herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club face insert comprising:

a planar member comprising a front surface, a back surface, a first upper edge, a first lower edge, and a plurality of holes, wherein at least one of the plurality of holes has a perimeter edge comprising a second upper edge disposed closer to the first upper edge and a second lower edge disposed closer to the first lower edge, wherein the perimeter edge is disposed proximate the front surface of the sheet, and wherein the radius of the perimeter edge varies around the at least one hole.

2. The golf club face insert of claim 1, wherein the second lower edge has a smaller radius than the second upper edge.

3. The golf club face insert of claim 2, wherein the second lower edge has a radius of up to 0.005 inch, and wherein the second upper edge has a radius of 0.010 inch to 0.040 inch.

4. The golf club face insert of claim 1, wherein each of the plurality of holes has a perimeter edge with a variable radius.

5. The golf club face insert of claim 1, wherein the planar member is composed of a rigid material, and wherein the planar member has a thickness of no less than 0.005 inch and no more than 0.100 inch.

6. The golf club face insert of claim 1, wherein at least one of the plurality of holes is a through-hole that extends completely through the planar member.

7. The golf club face insert of claim 6, further comprising a backing, wherein the backing comprises at least one protrusion that extends into the through-hole.

8. The golf club face insert of claim 7, wherein the protrusion comprises an angled upper surface with a slope of 5° to 20°.

9. The golf club face insert of claim 8, wherein the angled upper surface comprises an uppermost edge located proximate the second lower edge and a lowermost edge located proximate the second upper edge.

10. The golf club face insert of claim 8, wherein the protrusion comprises a protrusion edge having a constant radius that is equivalent to the radius of the second lower edge.

11. The golf club face insert of claim 1, wherein the planar member is composed of a metal material.

12. The golf club face insert of claim 1, wherein the planar member is composed of a polymeric material.

13. A golf club head comprising:

a body comprising a top surface, a bottom surface, a heel side, a toe side, and a face recess; and a face insert comprising a planar member and a backing, wherein the planar member comprises a front surface, a first upper edge, a first lower edge, and a plurality of holes extending into the front surface, wherein each of the plurality of holes has a perimeter edge comprising a second upper edge disposed closer to the first upper edge and a second lower edge disposed closer to the first lower edge, wherein each perimeter edge is disposed proximate the front surface of the planar member, wherein each perimeter edge has a variable radius, wherein the second lower edge has a radius that is less than a radius than that of the second upper edge, wherein the face insert is sized to fit within the face recess, and wherein the face insert is secured within the face recess with an adhesive material.

14. The golf club head of claim 13, wherein the golf club head is selected from the group consisting of a fairway head, driver head, hybrid head, iron head, and putter head.

15. The golf club head of claim 13, wherein at least one of the plurality of holes is a through-hole that extends completely through the planar member.

16. The golf club head of claim 15, wherein the backing comprises at least one protrusion that extends into the through-hole.

17. The golf club head of claim 16, wherein the protrusion comprises an angled upper surface with a slope of 5° to 20°.

18. The golf club head of claim 17, wherein the protrusion comprises a protrusion edge having a constant radius.

19. The golf club head of claim 18, wherein the radius of the protrusion edge is equivalent to the radius of the second lower edge.

* * * * *